US009278253B2

(12) United States Patent
Ho et al.

(10) Patent No.: US 9,278,253 B2
(45) Date of Patent: Mar. 8, 2016

(54) ABDOMEN EXERCISE BENCH

(71) Applicants: Wei-Teh Ho, Taipei (TW); Willy Wei Yu Ho, Taipei (TW)

(72) Inventors: Wei-Teh Ho, Taipei (TW); Willy Wei Yu Ho, Taipei (TW)

( * ) Notice: Subject to any disclaimer, the term of this patent is extended or adjusted under 35 U.S.C. 154(b) by 0 days.

(21) Appl. No.: 14/742,651

(22) Filed: Jun. 17, 2015

(65) Prior Publication Data

US 2015/0375037 A1 Dec. 31, 2015

Related U.S. Application Data

(63) Continuation-in-part of application No. 14/315,200, filed on Jun. 25, 2014.

(51) Int. Cl.
*A63B 23/02* (2006.01)
*A63B 21/00* (2006.01)
*A63B 21/068* (2006.01)

(52) U.S. Cl.
CPC ..... *A63B 23/0222* (2013.01); *A63B 21/00185* (2013.01); *A63B 21/068* (2013.01); *A63B 21/4031* (2015.10); *A63B 21/4035* (2015.10); *A63B 21/4047* (2015.10); *A63B 23/0211* (2013.01); *A63B 2210/50* (2013.01)

(58) Field of Classification Search
CPC ..... A63B 21/1457; A63B 21/1453
See application file for complete search history.

(56) References Cited

U.S. PATENT DOCUMENTS 4,789,152 A * 12/1988 Guerra ..... A63B 21/00047 482/108
8,734,304 B2 * 5/2014 Webber ..... A63B 21/0628 482/140

* cited by examiner

*Primary Examiner* — Loan H Thanh
*Assistant Examiner* — Rae Fischer
(74) *Attorney, Agent, or Firm* — Blakely, Sokoloff, Taylor & Zafman LLP

(57) ABSTRACT

An exercise machine applicable for strengthening a user's abdominal muscles is described. The exercise machine can include a base frame, a seat assembly and a backrest assembly rotatably coupled with the base frame. The base frame can include side members and a crossbar member to provide floor support. The backrest assembly may be configured to swivel with rotational movements around at least one axis of rotation. The backrest assembly may include at least one swivel structure and two handle bars. Each swivel structure may be rotatable around a separate axis of rotation. The handle bars may be mounted substantially transverse to a particular axis of rotation. The seat assembly can include a seat pad affixed to the crossbar member to allow a user sitting on the seat pad to cause the swiveling of the backrest assembly via hand pushes on the handle bars.

6 Claims, 3 Drawing Sheets

ABDOMEN EXERCISE BENCH

CROSSS-REFERENCE TO RELATED APPLICATIONS

The present application is a continuation in part of U.S. patent application Ser. No. 14/315,200, filed on Jun. 25, 2014, entitled "ABDOMEN EXERCISE BENCH", which is hereby incorporated by reference in its entirety into this application.

FIELD OF INVENTION

The present invention relates generally to physical training machines, and in particular, exercise machines structured to facilitate swivel movements for exercising the abdominal muscles of a user.

BACKGROUND

With the growing awareness of health problems caused by a lack of exercise, popularity of exercising machines has increased steadily. Typically, these machines are designed for movements of specific body parts. For example, abdominal machines may be structured to induce exercises to strengthen the abdominal muscles.

Existing abdominal machines, however, are usually designed based on variations of the sit-up exercises. Effective abdominal exercises may incorporate a combination of movements involving a variety of muscles including the torso, legs, backs etc. Although there are many exercise machines available for exercising different parts of the body, these multipurpose exercise machines are usually heavy and expensive devices. Further, these devices are often designed to provide passive support for simple pivoting movements.

Therefore, traditional abdomen machines are not structured economically and effectively to facilitate a user to exercise abdomen muscles with active supports to induce difficult movements with high strength impacts.

SUMMARY OF THE DESCRIPTION

An exercise machine can be configured with a back support movable in a swivel manner to facilitate forward/backward leaning in upper body movements. Handle bars coupled to the back support can allow a user to exert push pressure to cause the swivel movement of the back support for a user to exercise abdominal muscles.

In one embodiment, an exercise machine can include a base frame, a seat assembly and a backrest assembly rotatably coupled with the base frame. The base frame can include side members and a crossbar member to provide floor support. The side members may include a first side member and a second side member, the crossbar member transversely coupled between the first and second side members. The backrest assembly may define at least one axis of rotation. In one embodiment, the backrest assembly is configured to swivel with rotational movements around at least one axis of rotation. The backrest assembly may include at least one swivel structure and two handle bars. Each swivel structure may be rotatable around a separate axis of rotation. The handle bars may be mounted substantially transverse to one of the axes of rotation. In one embodiment, the seat assembly can include a seat pad. The seat assembly may be affixed to the crossbar member to allow a user sitting on the seat pad to cause the swiveling of the backrest assembly via hand pushes on the handle bars.

Other advantages and features of the present invention will become manifest to those versed in the art upon making reference to the detailed description and the accompanying sheets of drawings in which a preferred structural embodiment incorporating the principles of the present invention are shown by way of illustrative examples.

BRIEF DESCRIPTION OF THE DRAWINGS

The present invention is illustrated by way of examples and not limitations in the figures of the accompanying drawings, in which like references indicate similar elements and in which.

DETAILED DESCRIPTION

In the following description, numerous specific details are set forth, such as examples of external surfaces, named components, connections between components, etc., in order to provide a thorough understanding of the present invention. It will be apparent, however, to one skilled in the art that the present invention may be practiced without these specific details. In other instances, well known components or methods have not been described in detail but rather in a block diagram in order to avoid unnecessarily obscuring the present invention. Further specific numeric references such as first, second, third, etc., may be made. However, the specific numeric references should not be interpreted as a literal sequential order but rather interpreted as references to different objects. Thus, the specific details set forth are merely exemplary. The specific details may be varied from and still be contemplated to be within the spirit and scope of the present invention.

Reference in the specification to "one embodiment" or "an embodiment" means that a particular feature, structure, or characteristic described in connection with the embodiment can be included in at least one embodiment of the invention. The appearances of the phrase "in one embodiment" in various places in the specification do not necessarily all refer to the same embodiment.

Figure 1:
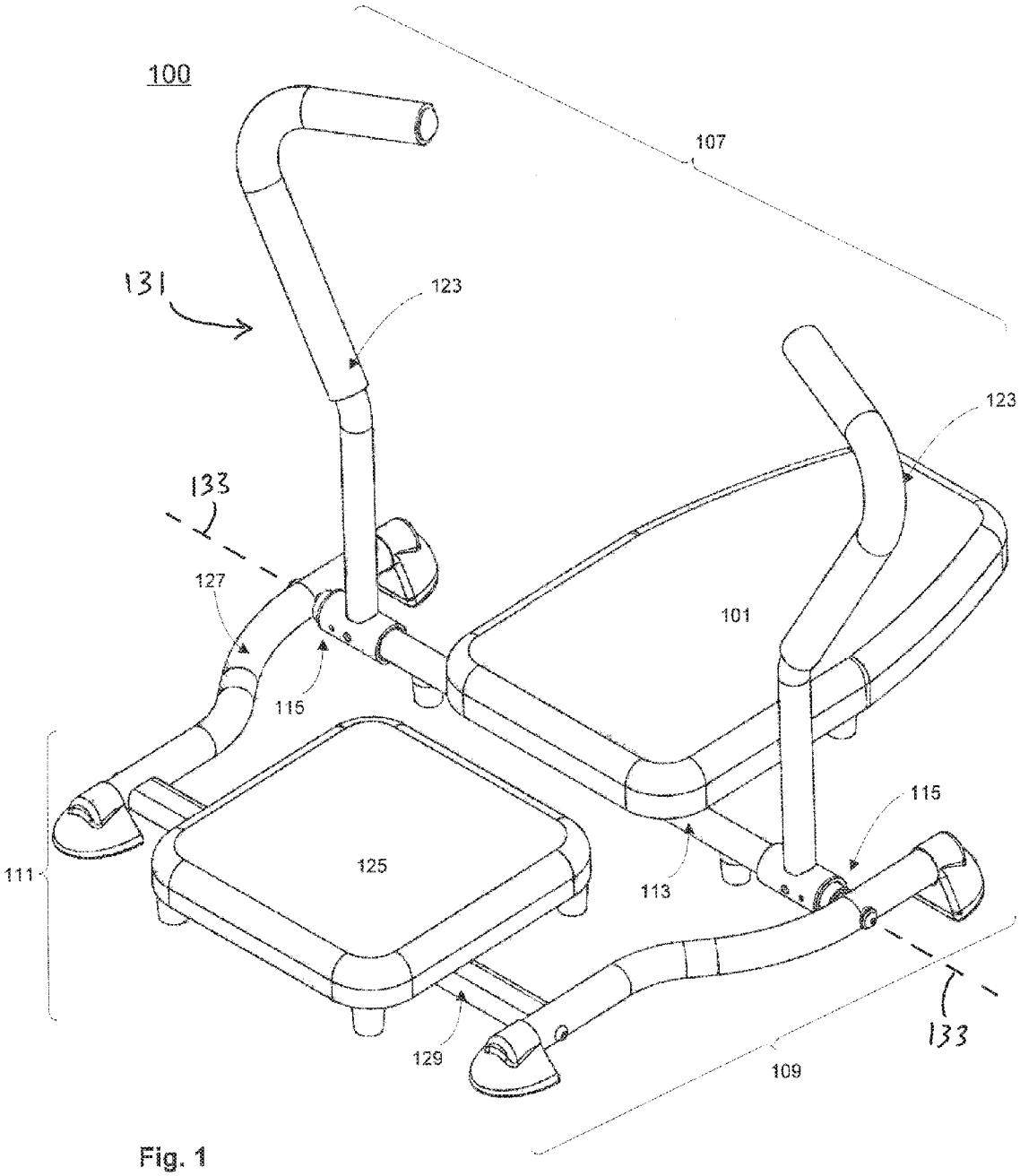
FIG. 1 is a perspective view of an exercise machine assembly according to an embodiment of the present invention.

FIG. 1 is a perspective view of an embodiment of an exercise machine assembly. Exercise machine (or device) 100 can include base frame 109 to provide floor support (and/or sitting support) and backrest assembly 107 rotatably coupled with base frame 109 to move in a swivel pattern to induce effective exercise movements of a user of device 100. The swivel pattern may include at least one dimensional rotation around one or more axes simultaneously to facilitate the user to lean forward with simple hand pushes.

Base frame 109 may include at least one (e.g. a first and a second) side member 127 and crossbar member 129 transversely coupled in between. Device 100 may include seat assembly 117 having seat pad 125 affixed to crossbar member 129 to provide sitting support. Crossbar member 129 and seat pad 125 may be configured at a height close to the ground of base frame 109 to facilitate or compel a user sitting on seat pad 125 to bend his/her knees when performing exercise movements for abdominal muscles.

In one embodiment, backrest assembly 107 may be configured or structured in device 100 with one or more axes of rotation transversely to the longitudinal direction of device 100. In other words, backrest assembly 107 may rotate, pivot or swivel back and forth longitudinally along device 100 with single or simultaneous rotational movements around one or multiple axes of rotation, e.g. relative to base frame 109.

Backrest assembly 107 may include backrest pad 101 which can move according to a swivel or pivoting pattern with the swiveling of the backrest assembly 107. For example, backrest assembly 107 may be configured with at least one pair of pivot joints 115 rotatably affixed respectively to two side members 127. Each pair of pivot joints can define one of the axes of rotation. Backrest assembly 107 can include at least one pair of handle bar 123 mounted substantially transverse to the axes of rotation.

Backrest assembly 107 can include one or more swivel structures 131 to allow simultaneous rotation movements around one or more axes of rotation 133. For example, backrest assembly 107 may include swivel structure 131 having a pair of pivot joints 115 pivotally coupled with base frame 109. The swivel structure 131 may include pivot bar 113 arranged between pivot joints 115. Pivot bar 113 may define an axis of rotation 131 of the swivel structure 131.

In one embodiment, handle bar 123 may be configured in a curved tubular manner with adjustable heights for ease of operation (e.g. hand grips). A user sitting on seat pad 125 may cause the swiveling of backrest assembly 107 via hand pushes on handle bars 123. In other words, push force exerted on handle bars 123 may result in a torque force for backrest pad 101 to pivot around pivot bar 113 via the swivel structure 131.

Figure 1B:
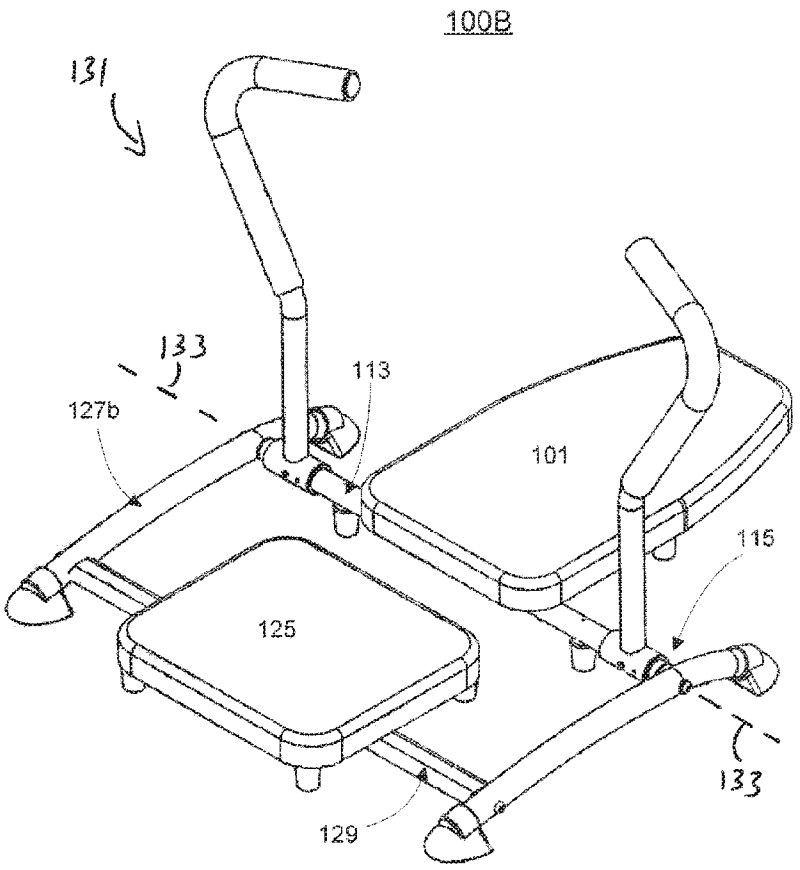
FIGS. 1A-1B are perspective views of exercise machine assemblies according to some embodiments of the present invention.
Figure 1A:
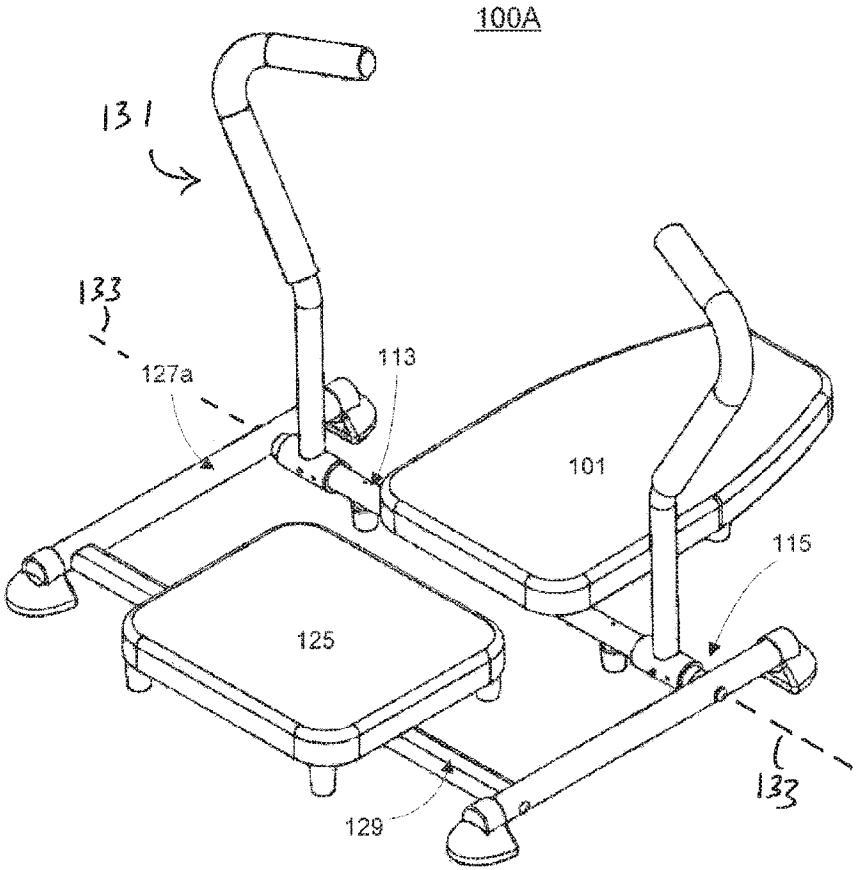

FIGS. 1A-1B are perspective views of exercise machine assemblies according to some embodiments of the present invention, for example, similar to device 100 of FIG. 1. Turning now to FIG. 1A, device 100A of Figure 1A may include side members 127*a* configured in a substantially straight manner so that pivot bar 113 and crossbar member 129 may be structured with a similar length (e.g. for ease or compactness of device storage). In FIG. 1B, device 100B may include side members 127*b* arranged in a vertically curved manner, for example, to provide a height difference between backrest pad 101 and seat pad 125 (or to raise up pivot bar 113 above the crossbar member 129).

Figure 2:
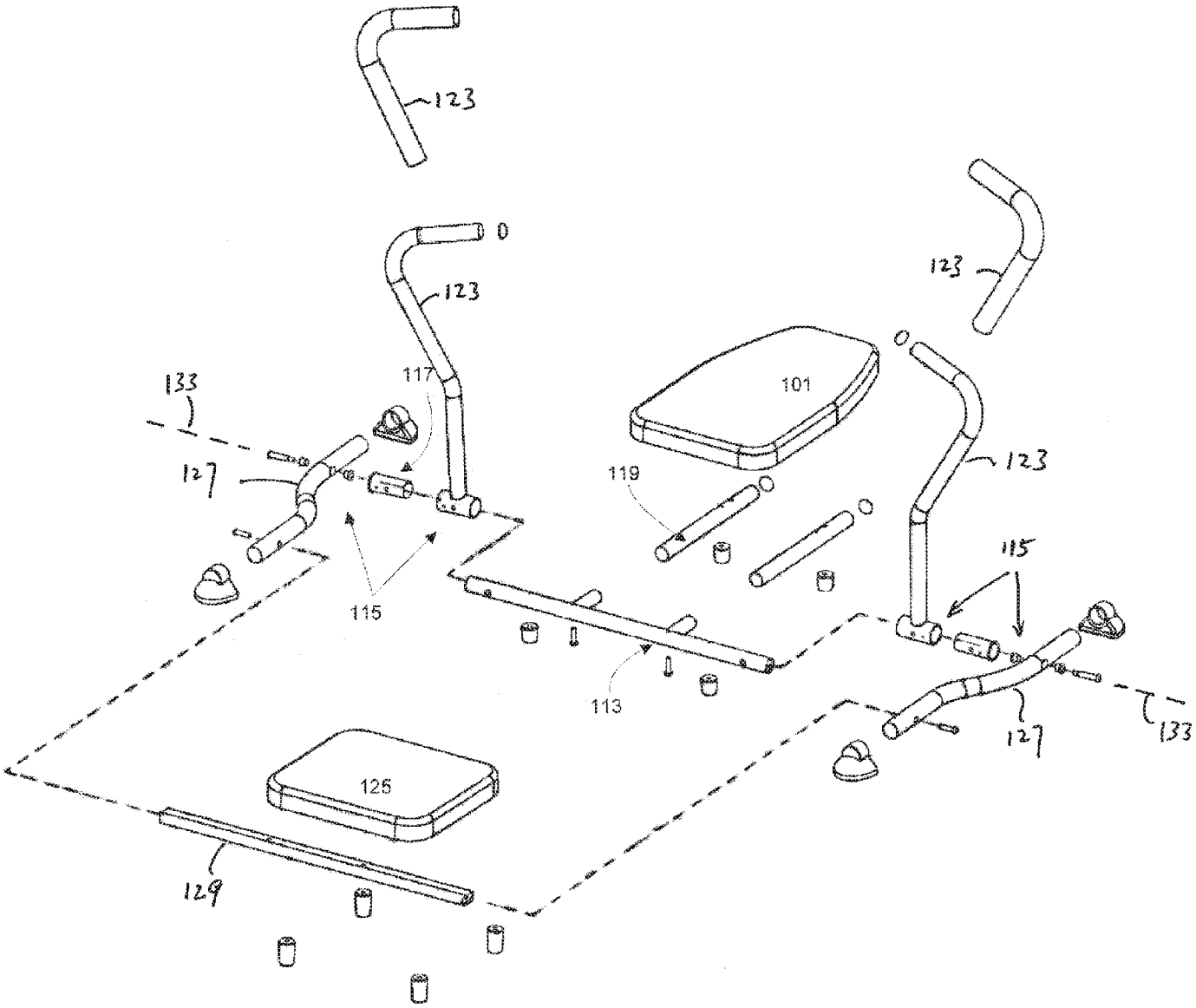
FIG. 2 is an exploded view of an exercise machine assembly according to an embodiment of the present invention.

FIG. 2 is an exploded view of an embodiment of an exercise machine assembly as shown in FIG. 1. In one embodiment, a swivel structure of backrest assembly 107 may include one or more support bars 119 transversely affixed to pivot bar 113 in a substantially coplanar manner (e.g. aligned with a surface of backrest pad 101). The backside of backrest pad 101 may be affixed to support bars 119. Optionally or alternatively, backrest pad 101 may be adjustably fixated to backrest assembly 107 along different longitudinal positions of support bars 119

Backrest assembly 107 may include one or more detachable coupling structures 117 to transversely affix handle bars 123 to pivot bar 113. One end of handle bar 123 may be configured with one coupling structure 117. In one embodiment, coupling structure 117 may include a control to allow attachment or detachment between backrest assembly 107 and base frame 109. For example, handle bars 123 may be detached for ease of storage (e.g. saving storage space) or re-attached for operating the exercise device.

The control of coupling structure 117 may include latch(es), screw(s) or other applicable mechanisms for assembling, dissembling and/or configuring the exercise device. For example, a latch may be switched (or turned, tightened) to secure or tighten engagement between handle bar 123 and pivot bar 113. In some embodiments, handle bar 123 may be configured in a folded position or disengaged from pivot bar 113 when the latch is switched off (or loosened).

During operations of an exercise device, such as device 100, a user can sit on seat pad 125 with the user's back resting on backrest pad 101, knees bent and feet on the floor. Handle bars 123 may be grasped with forward pressure (e.g. via hand push force). As a result, backrest pad 101 can pivot in a swivel manner to push the upper body of the user leaning forward while maintaining the knees bent. The user can pull handle bars back to return back to a back resting position. As a result, abdominal muscles can be effectively strengthened via repeated swiveling exercise movements.

Alternatively, a user can sit on seat pad 125 with the user's back resting on backrest pad 101, knees bent towards the right side or the left side, feet on the floor. The user can perform similar exercise movements while maintaining knees bent towards the right side or towards the left side.

The exercise machine assemblies disclosed above can be implemented in various designs. Exemplary designs of the exercise machine assembly can be found, for example, in U.S. Design patent application Ser. No. 29/509,265, entitled "ABDOMINAL EXERCISER BENCH," filed Nov. 14, 2014, U.S. Design patent application Ser. No. 29/508,540, entitled "ABDOMINAL EXERCISER BENCH," filed Nov. 7, 2014, and U.S. Design patent application Ser. No. 29/523,867, entitled "ABDOMINAL EXERCISER BENCH," filed Apr. 14, 2015, which contents are hereby incorporated by reference herein in their entirety.

Many modifications and other embodiments of the invention set forth herein will come to mind to one skilled in the art to which the invention pertains having the benefit of the teachings presented in the foregoing description and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An exercising machine consisting of:

a base frame comprising side members and a crossbar member to provide floor support, the side members including a first side member and a second side member, the crossbar member transversely coupled between the first and second side members;

a backrest assembly rotatably coupled with the base frame, the backrest assembly comprising an axis of rotation, the backrest assembly configured to swivel with rotational movements around the axis of rotation, the backrest assembly comprising:

a swivel structure rotatable around the axis of rotation, the swivel structure including a pivot bar arranged longitudinally aligned with the axis of rotation and a support bar transversely affixed to the pivot bar, and two handle bars mounted to the pivot bar substantially orthogonal to the axis of rotation, wherein the handle bars are configured to allow force exerted on the handle bars to cause swiveling of the support bars around the pivot bar; and a seat assembly comprising a seat pad, the seat assembly affixed to the crossbar member to allow a user sitting on the seat pad to cause the swiveling of the backrest assembly via hand pushes on the handle bars.

2. The exercising machine of claim 1, wherein the swivel structure includes a pair of pivot joints, and wherein the axis of rotation is defined by the pair of pivot joints and the pivot bar is rotatably coupled to the pair of pivot joints.

3. The exercising machine of claim 2, wherein the backrest assembly further comprises:

a backrest pad affixed to the swivel structure longitudinally via the support bars; and two detachable coupling structures to transversely affix the handle bars to the pivot bar, each handle bar having one end configured with one coupling structure.

4. The exercising machine of claim 3, wherein the handle bars are detachable from the pivot bar via the coupling structure.

5. The exercising machine of claim 3, wherein the force exerted on the handle bars creates a torque force that results in the swiveling of the backrest assembly.

6. The exercising machine of claim 3, wherein the support bars are arranged in a substantially coplanar manner aligned with the backrest pad.

* * * * *